United States Patent [19]

Garofalo

[11] Patent Number: 4,757,356

[45] Date of Patent: Jul. 12, 1988

[54] COPYING WITH AUTO SORT/STACK SELECTION

[75] Inventor: Michael A. Garofalo, Rochester, N.Y.

[73] Assignee: Xerox Corporation, Stamford, Conn.

[21] Appl. No.: 98,831

[22] Filed: Sep. 21, 1987

[51] Int. Cl.[4] ..... G03G 15/00

[52] U.S. Cl. ..... 355/14 SH; 355/14 R; 271/298

[58] Field of Search ..... 355/14 SH, 14 R, 14 C, 355/3 SH, 23-26; 271/3, 3.1, 258-259, 279, 298

[56] References Cited

U.S. PATENT DOCUMENTS

| | | | |
|---|---|---|---|
| 3,744,790 | 7/1973 | Hoffman | 271/64 |
| 3,871,643 | 3/1975 | Kukucka et al. | 271/173 |
| 4,012,032 | 3/1977 | Rogers | 271/64 |
| 4,078,787 | 3/1978 | Burlew et al. | 271/3.1 |
| 4,114,871 | 9/1978 | Botte | 271/173 |
| 4,156,133 | 5/1979 | Legg | 235/92 SB |
| 4,212,457 | 7/1980 | Guenther | 271/288 |
| 4,248,525 | 2/1981 | Sterrett | 355/14 SH |
| 4,273,439 | 6/1981 | Markham et al. | 355/14 |
| 4,285,591 | 8/1981 | Botte et al. | 355/14 |
| 4,297,025 | 10/1981 | Bach et al. | 355/14 SH |
| 4,330,200 | 5/1982 | Kikuchi et al. | 355/24 |
| 4,361,320 | 11/1982 | Kikuchi et al. | 271/288 |

FOREIGN PATENT DOCUMENTS

| | | | |
|---|---|---|---|
| 61-130970 | 6/1986 | Japan | 355/14 SH |

*Primary Examiner*—R. L. Moses
*Assistant Examiner*—J. Pendegrass

[57] ABSTRACT

In a copier with a sorter with plural bins for collating the copier output copies, and an alternate copy output tray (which may be separated or comprise one bin of the sorter) and a document feeder for sequentially feeding one or more document sheets placed therein to the copier to be copied, and a copy count control for selecting one or more copies to be made by the copier and copy sheet output switching for switching the copy output to the sorter for collation or to the alternate copy output tray for stacking; an automatic document sheet sensing system provides signals indicative of whether or not more than one document sheet had been placed into the document feeder by sensing the feeding of one (the first) document sheet by the document feeder to be copied and the presence or absence of at least one additional document sheet in the document feeder, and a copier control responsive to either a signal indicative of only one document sheet or to the selecting of only one copy in the copy count control to automatically control the copy sheet output switching to direct all of the copy output to the alternate copy output tray, this control also being responsive to the combination of signals indicative of more than one document sheet and the selecting of more than one copy to automatically direct the copy output to the plural bins of the sorter, whereby the copy output may be individually fed to a number of the plural bins of the sorter corresponding to the copy count. The document sheet sensing system may comprise two sensors spaced along the document feeding path.

6 Claims, 1 Drawing Sheet

COPYING WITH AUTO SORT/STACK SELECTION

Figure 1:
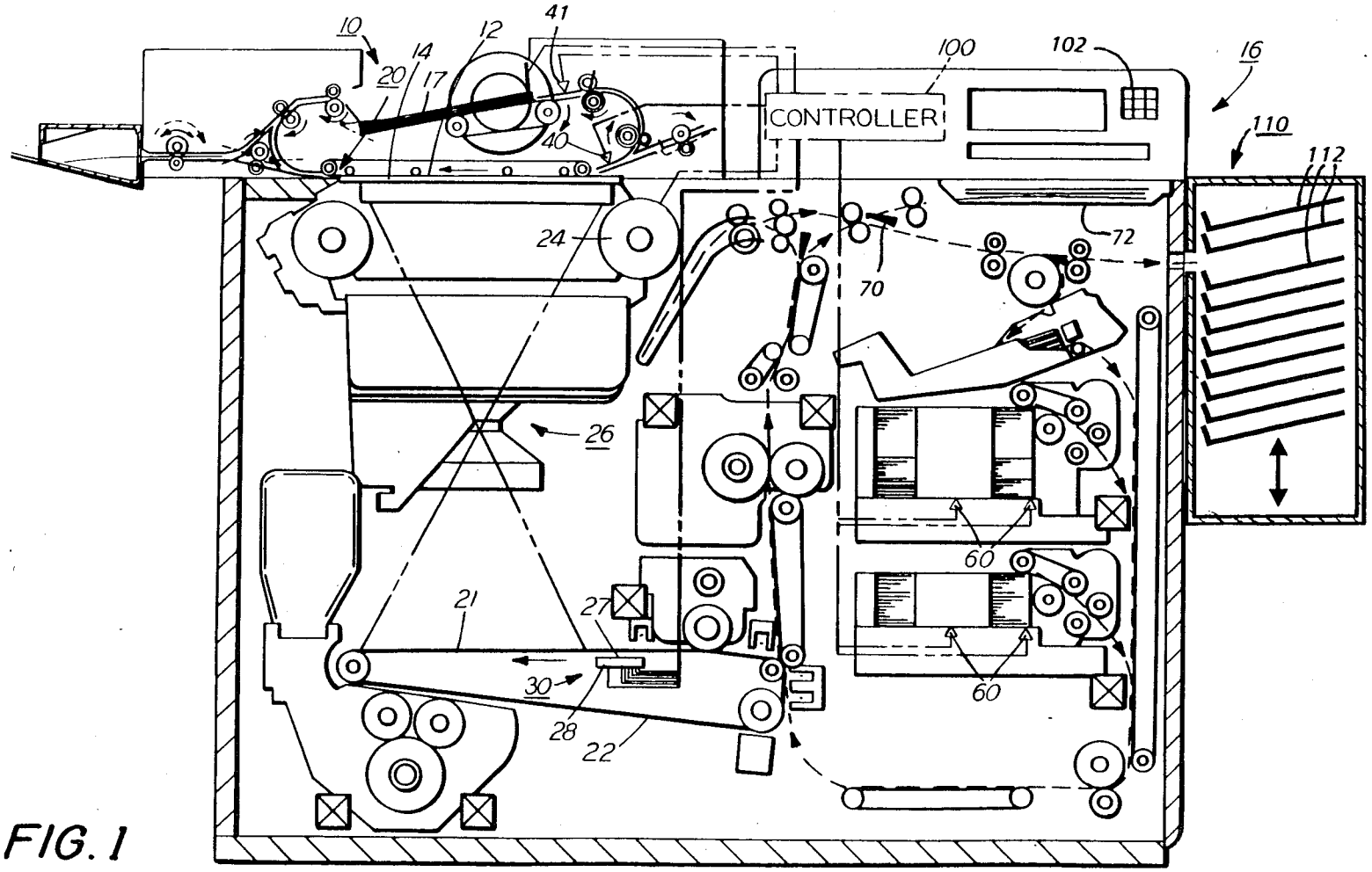

The present invention provides an improved copying system wherein an automatic selection of sorter output vs. stacking output is made by an automatic determination of whether one, or more than one, documents are being copied and whether one, or more than one, copy set is being made, so as to provide the most appropriate copy output for operator convenience without requiring any manual selection by the operator.

There is a particular need in modern copier technology to make copiers more "user friendly", so that anyone, even a casual operator, can walk up to even a complex, multi-featured, copier and obtain desired copying in a desired manner with a minimum of confusing operator selections. The present system anticipates an operators need for the most appropriate output without requiring any instructions, inputs or switch selections to or by the operator. It avoids the operator having to remember or understand and make manual selections to avoid undesirable copying results. In particular, the present system avoids the undesirable stacking of plural uncollated output sets which would require later manual operator collation into separate copy sets. Yet it also provides single copy sets, and multiple copies of a single document sheet, (neither of which require collation) at a convenient single tray output, rather than being undesirably separated into separate bins of the sorter output, which would require the operator to hand remove and hand assemble all these separated copies into a single set.

While manual selection to provide this choice of singles stack or sorter output has been provided for many years, the necessary switch selections by the operator are often not understood or forgotten even if display instructions are provided, leading to unnecessary wasted time by operators and/or operator frustration with the undesired output. If the operator does not make the proper switch selection of sort or nonsort (or collated or non-collated) undesired output will occur.

As shown by art cited herein, and as otherwise known in the art, switching the copy output from the sorter to another tray such as an overflow tray can be and is done automatically in certain special situations. For example, where a jam has occured which would otherwise result in improperly collated output, or where the capacity of the sorter would be exceeded by either the size of the document set (the number of document sheets to be copied) or by an excessive number of copy sets being selected for production, in excess of the number of available bins of the sorter. It is also known that a single tray for uncollated output may be the top bin of the sorter, or a separate output tray. Such systems have been known for many years, but are for a completely different function, for abnormal copying situations, and normally result in an undesirable mixture of outputs. That is, with part of the copy output in the bins of the sorter and part of the output in the overflow tray, uncollated. Obviously these special cases do not include either of the very common operating conditions addressed herein of either making only one copy of the document set or making any number of copies of only one document. However, it will be appreciated that these additional, special case, functions can be additionally combined with the present system with additional software utilizing the same hardware as used with the system herein, if desired.

An example of a suitable small copier, automatic document feeder (ADF) and sorter with which the present system may be utilized are shown respectively in U.S. Pat. No. 4,657,370 issued Apr. 14, 1987 to R. L. Forbes, et al, U.S. Pat. No. 4,655,578 issued Apr. 7, 1987 to R. L. Kurtz, et al, and U.S. Pat. No. 4,660,963 issued Apr. 28, 1987 (on copier details); Ser. No. 912,014 filed Sept. 26, 1986 (on an ADF); and U.S. Pat. 4,558,860 issued Dec. 17, 1985 to D. J. Stemmle (on a sorter). Other examples are cited herein, and one example is illustrated in the drawings and further described herein.

As indicated, a selection between collate and non-collate has been provided by manual switch actuation on copiers for some time. Yet what is provided here automatically has apparently not been provided on any previous copiers. Operators often forget to switch outputs and are frustrated by extra manual copy handling as a result.

What is disclosed here is initial and full job automatic switching between sort mode and non-sort mode of operation of a copier, where the copier has a sorter and an automatic document feeder. The copier automatically selects sort mode in response to sensing the presence of more than one document and the selection of more than one copy by the operator in the usual manner. i. e., when, and only when, both are greater than one, the copier automatically selects copy output to the sorter. It automatically selects non-sort (single stack stacking) if there is either only one original document or only one copy is selected of any number of documents. The copier controller software interrogates the number of copies selected and with an ADF with document sensors, determines if there is more than one loaded original and selected copy, in which case the software selects sort mode. This eliminates the need for an operator to remember to select sort when running quantities greater than one with more than one original.

This system is usable for any copier with a document feeder and a sorter and the usual copy count selector (switches, or knob) for the selection of more than one copy. The latter usually automatically default to one copy after a time-out delay. Such copiers have been well known for many years.

There is a long-felt need not to put multiple copies of a single original into different bins of the sorter. It is much handier for operator removal to put them all in one tray. To put it another way, it is known that one cannot, and does not ever want to try, to sort (collate), regardless of the number of copies selected, when there is only one original. It is well known that copies of a single original cannot be "collated", and therefore should normally be outputted as a single stack.

There is also a long appreciated need to not attempt to collate when only one copy set is made, from any number of originals. This is noted for example in the last paragraph of the Xerox Disclosure Journal Vol. 11, No. 3, pp. 135–6, published May/June 1986.

Additional background art includes Kodak Berlew et al U.S. Pat. No. 4,078,787 on an RDH precollation (not a sorter) system which switches to non-recirculation (non-precollation) copying for a single document. Also noted is Xerox Guenther U.S. Pat. No. 4,212,457 on automatically switching to sort (post-collate) for a copy count input above a preset number. Said Guenther U.S. Pat. No. 4,212,457 issued July 15, 1980, is programmed to automatically select between precollation or postcollation (multi-bin) modes, in response to a sufficiently large number of copy sets being selected. The machine in A. J. Botte, et al., U.S. Pat. No. 4,285,591 issued Aug. 25, 1981 (IBM), is programmed to automatically segment the collator job when the number of document sets desired exceeds the capacity of the collator. U.S. Pat. No. 4,156,133 issued May 22, 1979 to E. L. Legg has variable operating programs for specific copy runs.

The following additional references were noted by way of background pertaining to collators and finishers. U.S. Pat. No. 4,361,320 to Kikuchi et al discloses a sheet distributing apparatus comprising a plurality of bins divided into two groups which are utilized alternatively when the number of copies to be collated exceeds the number of bins available. This allows an operator to remove collated copies from one group of bins while copies are being collated in the other group of bins (see, e.g., Col.2, lines 13–21). U.S. Pat. No. 4,248,525 to Sterrett (Kodak) discloses a programmable apparatus for producing sets of copies from a set of document sheets, some of which copies can be produced in an RDH collating mode by means of a recirculating feeder and others cannot be produced in a collating mode. The copies that are produced in a noncollating mode are stored temporarily. Programming controls the making of copies in a collating mode and the delivery of copies temporarily stored so that the copies arrive at a receiver or finisher in collated sets of copies with the page order of the copy sets corresponding to the page order of the document set. A copy storage section 14 has a plurality of deflectors 96 for deflecting copy sheets into temporary storage bins 82. Copy sheets are then delivered from the bins 82 to a finisher 16.

Botte U.S. Pat. No. 4,114,871, shows a sorter or collator operation automatically controlled by the condition of the document feed. The following references involve some automatic control in relation to a sorter output: U.S. Pat. Nos. 4,012,032 to Rogers, and 4,330,200 to Kikuchi, et al. The following references involve an automatic or logic function in copiers with a sorter and an ADF: U.S. Pat. Nos. 4,273,439 to Markham, et al, and 4,297,025 to Bach, et al. Of collateral or background interest are U.S. Pat. No. 3,744,790 to Hoffman and U.S. Pat. No. 3,871,643 to Kukucka, et al.

Conventional multibin postcollation sorters in which the bins move up and down as a unit have been known for many years per se. e.g., the Xerox Corporation "4500" copier sorter, show for example in U.S. Pat. No. 3,788,640 issued Jan. 29, 1974 to D. J. Stemmle. Also noted re a post-collation moving bin array, with seperate copy sheet loading and finishing set removal systems, is U.S. Pat. No. 4,564,185 issued Jan. 14, 1986 to T. J. Hamlin. A choice of stapling or glue binding finishing modes is also provided. Other dual finishing mode finishers are noted, for example, in Xerox Corporation U.S. Pat. No. 4,586,640 by Charles E. Smith; and Eastman Kodak PCT/US83/00800 published Dec. 8, 1983, (priority U.S. Ser. No. 380,966, May 24, 1982).

Features disclosed herein include, in a copier with a sorter with plural bins for collating the copier output copies, and an alternate copy output tray, and a document feeder for sequentially feeding one or more document sheets placed therein to the copier to be copied, and copy count control means for selecting a copy count of one or more copies to be made by the copier from the document sheets, and copy sheet output switching means for selectably switching said copy output to respective said bins of said sorter for collation or to said alternate copy sheet output tray for stacking therein; the improvement comprising:

document sheet sensing means for sensing and providing control signals indicative of whether or not more than one document sheet is placed in said document feeder by sensing the feeding of one (the first) document sheet by the document feeder to be copied and the presence or absence of at least one additional document sheet in said document feeder, and copier control means electrically connecting with said document sheet sensing means and said copy count control means, said control means being responsive to said signals from said automatic document sheet sensing means indicative of only one document sheet, or to the selecting of only one copy count in said copy count control means, to automatically control said copy sheet output switching means to direct all of said copy output of said copier to said alternate copy sheet output tray, said control means also being responsive to the combination of said signals from said automatic document sheet sensing means indicative of more than one document sheet, and the selecting of more than one copy count in said copy count control means, to automatically control said copy sheet output switching means to direct said copy output of said copier to said plural bins of said sorter.

Further disclosed features, individually or in combination, include those wherein when said copy output is so switched to said sorter by said copier control means said copy output is individually fed to a number of said plural bins of said sorter corresponding to said copy count in said copy count control means;or wherein said document sheet sensing means comprises a combination of first and second sensing means in the document feeding path to the copier, said second sensing means being spaced from said first sensing means and positioned adjacent a document input stacking area of said document feeder.

Further disclosed features include an improved copying method for a copier with a plural bin sorter for collating the copier output copies in plural bins, and an alternate copy output tray (which may be separate or comprise one bin of the sorter), and a document feeder for sequentially feeding one or more document sheets placed therein to the copier to be copied, and a copy count control for selecting one or more copies to be made by the copier from the document sheets, and copy sheet output switching means for selectably directing the copy output to respective bins of said sorter for collation or to said alternate copy sheet output tray for stacking therein; the improvement comprising the steps of:

sensing and providing signals indicative of whether or not more than one document sheet had been placed into said document feeder by sensing the feeding of one (the first) document sheet by the document feeder to be copied and the presence or absence of at least one additional document sheet in said document feeder, automatically controlling said copy sheet output switching means to direct all of the copy output of said copier to said alternate copy sheet output tray in response to said signals indicative of only one document sheet being placed in said document feeder, or to the selecting of only one copy in said copy count control, and automatically controlling said copy sheet output switching means to direct the copy output of said copier to said plural bins of said sorter in response to the combination of said signals indicative of more than one document sheet and the selecting of more than one copy in said copy count control.

Futher disclosed is wherein when said copy output is so switched to said sorter said copy output is individually fed to a number of said plural bins of said sorter corresponding to the number of copies selected in said copy count control; and/or wherein said sensing and providing signals step comprises sensing the presence or absence of a document sheet at two different spaced apart portions along the document feeding path to the platen in said document feeder.

In the description herein the terms "document" or "sheet" refer to a usually flimsy sheet of paper, plastic, or other such conventional individual image substrate, and not to microfilm or electronic images which are generally much easier to manipulate. It is important to distinguish copiers with physical document sheet recirculators from electronic copying systems, such as the Xerox "9700" printer, which can read and store page images of documents electronically and can reorder and represent them at will and without delays; and create copies (called prints) by writing the page images on a photoreceptor with a laser beam, or the like, since they do not have the difficulties of physical sheet documents.

The "document" here is the sheet (original or previous copy) being copied in the copier onto the outputted "copy sheet", or "copy". Related plural sheets of documents or copies are referred to as a "set". A "simplex" document or copy sheet is one having an image and page on only one side or face of the sheet, whereas a "duplex" document or copy sheet has a "page", and normally an image, on both sides. The "copy" may have an electronically modified or merged image, e.g., a highlight color overlay or insert.

Some examples of other prior art copiers with document handlers, and especially with control systems therefor, including operator console switch selection inputs, document sheet detecting switches, etc., are disclosed in U.S. Pat. Nos: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270; and 4,475,156. It is well known in this art, and in general, how to program and execute document handler and copier control functions and logic with conventional or simple software instructions for conventional microprocessors in a copier controller. This is taught by the above and other patents and various commercial copiers. Such software may vary depending on the particular function and particular microprocessor or microcomputer system utilized, of course, but will be available to or readily programmable by those skilled in the applicable arts without experimentation from either descriptions or prior knowledge of the desired functions together with general knowledge in the general software and computer arts. It is also known that conventional or specified document and copy sheet handling functions and controls may be alternatively conventionally provided utilizing various other known or suitable logic or switching systems.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below. The present invention will be better understood by reference to this description of this embodiment thereof, including the drawing figures (approximately to scale), wherein:

FIG. 1 is a front view of one example of the present invention incorporated into an exemplary commercial xerographic copier and an associated exemplary document handler and sorter.

Describing now in further detail the one specific example illustrated in the Figure, there is shown a document handler (DH) 10, as shown for example in U.S. Pat. No. 4,579,444 issued Apr. 1, 1986 to T. S. Pinkney and H. J. Sanchez, including a platen transport system 12 thereof, or, alternatively, one as in U.S. Pat. No. 4,589,651 or 652 or the like, for sequentially transporting document sheets onto and over the conventional platen 14 of a copier 16. The platen transport system 12 is also adapted to automatically register each document sheet 17 at an appropriate registration position on the platen 14, such as at a corner or left and rear edge position. Registration is provided by an integral registration system 20 for engaging, stopping and deskewing, without damage, the lead edge of each document sheet 17 at the appropriate registration position on the platen 14.

It will also be appreciated that although the document handling system 10 shown here is a dual mode, recirculating or SADH, document handler, that the disclosed system may be variously utilized with or incorporated into a simple semiautomatic, fully automatic (stack fed ADF), and/or other document feeder, of which various examples have been provided in the references cited above, and their references.

The document handling system 10 and its platen transport system 12 illustrated here are exemplary, and may be readily modified for different copiers. Here, it has two separate document inputs, a recirculating or RDH input stacking tray on top, and an SADH side entrance at the right side for semiautomatic document handling, especially for larger documents, which may be optionally inserted short edge first there. A sensor 40 counts the number of document sheets being fed to be copied from either input.

The document 17 is then conventionally illuminated and copied by being imaged onto an image area 21 of the photoreceptor 22 of the copier 10. Sequential exposures of documents 17 are conventionally made onto sequentially spaced areas 21 of the photoreceptor 22.

The image areas 21 are determined by the size of the document 17 and by the imaging magnification (normally a reduction), which may be determined by the selected setting of a magnification control system 24 of a copier optical imaging system 26, as taught for example in U.S. Pat. No. 4,505,581 issued Mar. 19, 1985 to F. A. Seedhouse et al. The generic term variable "magnification" optical imaging system refers to either or both variable optical reduction or magnification of the document image. Although a full-frame optical system with one fixed position edge is shown in the FIG. 1 embodiment, it will be appreciated that the disclosed system may also be used with a center-registered optics system. It may also be used with scanning optics systems and with or without variable magnifications. Examples include U.S. Pat. Nos. 4,095,880, 4,093,374 and 4,032,231 and their cited references. Here, the areas of the photoreceptor 22 around and between the the image areas 21 (and even within these areas 21 in some cases) are exposed with charge dissipating flood illumination by selected elements 27 of a multielement flood or fade-out lamp system 28 at selected times controlled by the copier controller 100 to form an automatic fade-out system 30.

The exemplary copier 16 shown here is a modified version of the well known Xerox Corporation "1075" or "1090" xerographic copiers, illustrated and described in various patents. Since the system described herein may be readily utilized with various other conventional or appropriate copiers and sorters and document handlers, the nonrelevant details need not be described herein. Cross reference is made to a partially similar copier disclosure in U.S. Ser. No. 908,052 filed Sept. 16, 1986.

Copy sensors 60 or other known means may also be provided to measure the number, length and width of copy sheets being fed for copying.

The exemplary document sensor or sensor array 40 here is at the input to the platen, in an area which is common to both the RDH and SADH document paths, to sense the input of each document from either. Note that in this example the documents are being fed long-edge-first in the RDH mode, so that the length of the document is transverse the direction of motion of the document, and document width is the dimension in the document feeding direction here, but this could be reversed. An alternative is to provide a variable sensor or plural sensors sensing the repositioning of the RDH set counter, but that will not count SADH input documents. As the input documents are fed past this sensor area, one, or more, of the sensors 40 (or another separate sensor) may be interrogated by the controller 100 for its measured occlusion, to determine if one, or more than one, document sheet is being copied.

The exemplary copier 16 will be briefly described. The copier 16 conventionally includes a xerographic photoreceptor belt 22 and the xerographic stations acting thereon for respectively corona charging, image exposing, image developing, belt driving, precleaning discharge and toner cleaning. Documents on the platen 14 may be imaged onto the photoreceptor 22 through the variable reduction ratio optical imaging system 24, 26 to fit the document images to the selected size of copy sheets.

The control of all machine functions, including all sheet feeding, is, conventionally, by the machine controller 100. The controller 100 is preferably a known programmable microprocessor, exemplified by the previously cited art. The controller 100 conventionally controls all of the machine steps and functions described herein, and others, including the operation of the document feeder 10,12, all the document and copy sheet deflectors or gates, the sheet feeder drives, etc. As further taught in the references, the copier controller also conventionally provides for storage and comparison of the counts of the copy sheets, the number of documents recirculated in a document set, the desired number of copy sets and other selections and contols by the operator through the console or other panel of switches connected to the controller, etc. The controller is also programmed for time delays, jam correction control, etc. Conventional path sensors or switches may be utilized to help keep track of the position of the documents and the copy sheets and the moving components of the apparatus by connection to the controller. In addition, the controller variably regulates the various positions of the gates depending upon which mode of operation is selected.

The copier 16 is adapted to provide either duplex or simplex collated copy sets from either duplex or simplex original documents presented by the DH 10. Two separate copy sheet trays are provided for feeding clean copy sheets from either one selectably. The copy sheets are fed from these two selected one of the trays to the transfer station for the conventional transfer of the xerographic toner image of document images from the photoreceptor to the first side of a copy sheet. The copy sheets are then fed by a vacuum transport to a roll fuser for the fusing of that toner image thereon. From the fuser, the copy sheets are fed through a sheet decurler. The copy sheets then turn a 90° corner path in the sheet path which inverts the copy sheets into a last-printed face-up orientation before reaching a pivotal decision gate. The image side which has just been transferred and fused is face-up at this point. If this gate is down it passes the sheets directly on without inversion into the output path of the copier. If the gate is up it deflects the sheets into a duplex inverting transport. The inverting transport (roller) inverts and then stacks copy sheets to be duplexed in a duplex buffer tray. The duplex tray provides intermediate or buffer storage for those copy sheets which have been printed on one side and on which it is desired to subsequently print an image or images on the opposite side thereof, i. e. copy sheets in the process of being duplexed.

Further illustrated in this example is a keypad 102 connected to the controller 100, for conventionally enabling the operator to select the desired number of copies. As indicated herein, the controller 100 notes whether this selection is 1 or $>1$. As is conventionally practiced, if the operator does not make a selection, or the copier has not been used for a preset length of time, the controller 100 automatically reverts to a preset selection of only one copy, so that if the operator does not make any selection at all on the keypad 102 when the operator initiates copying, a single copy selection will be automatically made for the operator by the controller 100.

Another key input here is the number of documents to be copied. This is determined or accounted for automatically by a document sensor 40 or other document input sensors, or a stack or set sensor, as previously noted. For example a desirable system is to provide two sensors in the document path, one sensor being actuated by a document being fed to be copied, or already in the platen, and another sensor which is in an upstream position where any subsequent document is being held or stacked awaiting feeding. Such an upstream sensor 41 is illustrated in FIG. 1 at the output of the RDH documenttray in which the document sheets 17 are shown stacked. Alternatively it could be in the tray and/or at a document waiting station upstream of the SADH input. The presence of a document at the sensor 40 or the like, and the absence of a succeeding or subsequent document waiting to be fed at the upstream sensor 41 or the like, provides an indication to the connecting controller 100 that the operator has placed only one document in the document handler to be copied. The presence of documents occluding two sensors at two different positions spaced along the document input path (which may also be a combination of an in-path sensor and a conventional sensor for indicating the presence one or more documents in the document tray), will tell the contoller 100 that more than one document is to be fed. Thus, without any input from the operator, the controller 100 has all of the necessary information for making a system election here of sort vs. nonsort output.

Here, if there is more than one document in the ADF, and more than one copy selected, the copier automatically is put into the sort mode, and each copy normally goes to a different bin 112. But both numbers must be greater than one. Otherwise, if either is one, all copy output goes automatically only to the auxilliary, sort or top tray 72. The copier controller knows the selected copy count from the keypad input 102.

The ADF preferably tells if there is more than one document by knowing that one has been fed in by the ADF past the ADF feed-in sensor and at least one more is still in the ADF tray, or in a wait station, per an upstream ortray sensor. I. e., it knows it is handling at least two documents when one is to be copied and there is still at least one other detected somewhere in the ADF.

The in-tray or wait station document sensor can be of various different types, such as a typical ADF corner input sensor to the feeder, or an in-tray IR corner sensor like the one in the "1075" or "1090" copier RDH trays, or a set separator switch actuated by a finger which drops after the feed-out of all documents, e.g., U.S. Pat. No. 4,589,645, [however ADF's normally don't have set separators, since they don't recirculate documents].

This system could alternatively, but less desirably, be made to work with only one document sensor. For example, by counting the conventional controller software clock count output to provide a signal corresponding to an excessive time delay measured after the passage of the first document past the ADF feed-in sensor, since that would be indicative of no further document being available to be fed by the ADF to be copied.

In the example shown, this physical selection of copy sheet outputs is made by a known, conventional, output path gate 70 conventionally activated by a solinoid or the like by a signal from the controller 100. Here, when the gate 70 is actuated up, all of the copy sheets are automatically outputted to a sorter 110, and placed individually in individual bins 112. The sorter 100 may be any suitable or conventional type. Here it is a vertically moving bin type in which a different bin 112 is placed at the copy sheet output of the copier for each sheet to provide conventional post-collation or sorting. That is, if ten copies are selected to be made of each document on the keypad 102, each copy sheet of the first document is placed in one of ten bins. Then each copy sheet of the next document is placed on top of the preceeding copy sheet in each bin, etc., until all of the documents have been copied, to provide separate collated copy sets in each bin 112.

Alternatively, when the gate 70 is deflected down to its other position, all of the copy sheets are deflected into the alternative, nonsort, or stacking output. Here this is provided by the conventional auxiliary output stacking tray 72 in which all of the copy sheets may be stacked on top of one another. Note that in this embodiment, the stacking tray 72 is in a separate location (on top of the copier) from the sorter 110. However, as noted, it is known to provide a stacking tray integral the sorter itself, either on top of the sorter or by utilizing one of the trays 112, usually a top tray, in an alternative function for stacked output. However, as previously noted, that function has heretofore been provided by manual operator switch selection or automatically only in response to special situations such as jams, potential overloading of the bins by too many copy sheets, or oversized document sets which would exceed the number of available bins. Here, the selection is made automatically in advance of copying to puts all copies in either the tray 72 or individual bins 112 of the sorter 110, depending on the number of documents being copied (whether it exceeds 1) and the number of copy sets being made (whether it exceeds 1) to automatically provide the best possible output for the operator in two of the most common casual operator copying modes.

It is important to note that a conventional in-tray document presence sensor of an RDH or other document feeder cannot tell the difference between one, or more than one, document sheets in the tray and thus cannot per se provide the information needed for the present system.

Furthermore, the present system can even respond to a second document loaded separately, after the first, if a copy of the first document has not yet been made or the first copy not yet passed the output decision gate (70 here).

It will be appreciated from the teaching herein that various alternatives, modifications, variations or improvements therein be made by those skilled in the art. These are intended to be encompassed by the following claims:

What is claimed is:

1. In a copier with a sorter with plural bins for collating the copier output copies, and an alternate copy output tray, and a document feeder for sequentially feeding one or more document sheets placed therein to the copier to be copied, and copy count control means for selecting a copy count of one or more copies to be made by the copier from the document sheets, and copy sheet output switching means for selectably switching said copy output to respective said bins of said sorter for collation or to said alternate copy sheet output tray for stacking therein; the improvement comprising:

document sheet sensing means for sensing and providing control signals indicative of whether or not more than one document sheet is placed in said document feeder by sensing the feeding of one (the first) document sheet by the document feeder to be copied and the presence or absence of at least one additional document sheet in said document feeder, and copier control means electrically connecting with said document sheet sensing means and said copy count control means, said control means being responsive to said signals from said automatic document sheet sensing means indicative of only one document sheet, or to the selecting of only one copy count in said copy count control means, to automatically control said copy sheet output switching means to direct all of said copy output of said copier to said alternate copy sheet output tray, said control means also being responsive to the combination of said signals from said automatic document sheet sensing means indicative of more than one document sheet, and the selecting of more than one copy count in said copy count control means, to automatically control said copy sheet output switching means to direct said copy output of said copier to said plural bins of said sorter.

2. The copier of claim 1 wherein when said copy output is so switched to said sorter by said copier control means said copy output is individually fed to a number of said plural bins of said sorter corresponding to said copy count in said copy count control means.

3. The copier of claim 1 wherein said document sheet sensing means comprises a combination of first and second sensing means in the document feeding path to the copier, said second sensing means being spaced from said first sensing means and positioned adjacent a document input stacking area of said document feeder.

4. An improved copying method for a copier with a plural bin sorter for collating the copier output copies in plural bins, and an alternate copy output tray (which may be separate or comprise one bin of the sorter), and a document feeder for sequentially feeding one or more document sheets placed therein to the copier to be copied, and a copy count control for selecting one or more copies to be made by the copier from the document sheets, and copy sheet output switching means for selectably directing the copy output to respective bins of said sorter for collation or to said alternate copy sheet output tray for stacking therein; the improvement comprising the steps of:

sensing and providing signals indicative of whether or not more than one document sheet had been placed into said document feeder by sensing the feeding of one (the first) document sheet by the document feeder to be copied and the presence or absence of at least one additional document sheet in said document feeder, automatically controlling said copy sheet output switching means to direct all of the copy output of said copier to said alternate copy sheet output tray in response to said signals indicative of only one document sheet being placed in said document feeder, or to the selecting of only one copy in said copy count control, and automatically controlling said copy sheet output switching means to direct the copy output of said copier to said plural bins of said sorter in response to the combination of said signals indicative of morethan one document sheet and the selecting of more than one copy in said copy count control.

5. The copying method of claim 4 wherein when said copy output is so switched to said sorter said copy output is individually fed to a number of said plural bins of said sorter corresponding to the number of copies selected in said copy count control.

6. The copying method of claim 4 wherein said sensing and providing signals step comprises sensing the presence or absence of a document sheet at two different spaced apart portions along the document feeding path to the platen in said document feeder.

* * * * *